US007156073B2

(12) United States Patent
Kure

(10) Patent No.: US 7,156,073 B2
(45) Date of Patent: Jan. 2, 2007

(54) IDLE SPEED CONTROL APPARATUS IN THROTTLE BODY FOR SINGLE CYLINDER

(75) Inventor: Takeo Kure, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/215,083

(22) Filed: Aug. 31, 2005

(65) Prior Publication Data

US 2006/0065238 A1 Mar. 30, 2006

(30) Foreign Application Priority Data

Sep. 1, 2004 (JP) ..... 2004-254543

(51) Int. Cl.
*F02D 41/00* (2006.01)
*F02N 17/00* (2006.01)

(52) U.S. Cl. ..... 123/337; 123/339.24; 123/179.18

(58) Field of Classification Search ..... 123/337, 123/73 AD, 339.13, 339.23, 179.16, 179.18, 123/339.24
See application file for complete search history.

(56) References Cited

U.S. PATENT DOCUMENTS 5,048,483 A * 9/1991 Nakazawa ..... 123/327
5,415,143 A * 5/1995 Togai ..... 123/339.17
5,582,148 A * 12/1996 Hashimoto et al. .... 123/339.22
6,000,369 A * 12/1999 Koizumi ..... 223/179.16
6,041,754 A * 3/2000 Mori et al. ..... 123/339.23
6,634,334 B1 * 10/2003 Hwang et al. ..... 123/339.23
6,932,058 B1 * 8/2005 Nickel et al. ..... 123/438
6,990,940 B1 * 1/2006 Sakurai ..... 123/179.18
2001/0007250 A1 * 7/2001 Hattori et al. ..... 123/339.1

FOREIGN PATENT DOCUMENTS

JP 2005-351191 * 12/2005
JP 2006-125204 * 5/2006

* cited by examiner

*Primary Examiner*—Hai Huynh
(74) *Attorney, Agent, or Firm*—Bacon & Thomas PLLC

(57) ABSTRACT

A single idle air control passage (5) open toward a suction air passage (2*a*) downstream from a throttle valve (4), a starter passage (6) and an air screw passage (7) independently branched from an upstream side passage (5*a*) of the passage (5), an upstream side of passage (6) communicates with atmospheric air, a downstream side thereof communicates with the upstream passage (5*a*) of the idle air control passage (5), a start opening and closing valve (10) controlling an opening area of the passage is arranged in the starter passage (6), an upstream side of the passage (7) communicates with an atomospheric air, a downstream side communicates with the upstream side passage (5*a*) of the idle air control passage (5), and an air screw (11) controlling an opening area of the passage is screwed to the air screw passage.

2 Claims, 2 Drawing Sheets

(PRIOR ART)

IDLE SPEED CONTROL APPARATUS IN THROTTLE BODY FOR SINGLE CYLINDER

TECHNICAL FIELD

The present invention relates to a throttle body used in a fuel injection apparatus which boosts fuel within a fuel tank by a fuel pump and supplies the boosted fuel to an engine via a fuel injection valve, and more particularly to a single throttle body used in a single cylinder engine and a control apparatus of an idle air supplied to the engine at an idle time of the engine.

BACKGROUND ART

The idle air supplied to the engine at the idle time of the engine is separated into a normal idle air supplied in a normal temperature region including a hot time, and a first idle air supplied in a low temperature region of an engine atmosphere temperature.

In other words, in the normal temperature region of the engine, a predetermined idling operation of the engine is executed by the normal idle air.

Further, in the low temperature region of the engine, the first idle air increased in comparison with the normal idle air is supplied at a start time of the engine, and a low temperature start (a first idling operation) of the engine is executed by a hither rotational speed in comparison with the idling operation.

The supply of the normal idle air and the supply of the first idle air are particularly executed by an idle speed control apparatus shown in FIG. 2.

A description will be given with reference to the drawing. Reference numeral 20 denotes a single throttle body connected to a single cylinder engine via a suction air pipe (not shown). A suction air passage 21 is provided through in an inner portion of the throttle body, and the suction air passage is controlled so as to be opened and closed by a throttle valve 23 attached to a throttle valve shaft 22.

Reference numeral 24 denotes an air screw passage which bypasses the throttle valve 23, has a downstream side open to an inner side of a suction air passage 21*a* in a downstream side from the throttle valve 23, and has an upstream side open to a suction air passage 21*b* in an upstream side from the throttle valve 23. An air flowing within the air screw passage 24 is controlled by rotating an air screw 25 to variably adjust an opening area of the air screw passage 24.

In other words, the opening area of the air screw passage 24 can be reduced so as to reduce an amount of air flowing through the air screw passage 24, by the air screw 25 being adjusted to move in a downward direction in the drawing, and the opening area of the air screw passage 24 can be increased so as to increase an amount of air flowing through the air screw passage 24, by the air screw 25 being adjusted to move in an upward direction.

The air screw passage 24 mentioned above is used for controlling the normal idle air supplied to the engine in the normal temperature region including the hot time.

Reference numeral 26 denotes a starter passage which bypasses the throttle valve 23, has a downstream side open to the inner side of the suction air passage 21*a* in the downstream side from the throttle valve 23, and has an upstream side open to the suction air passage 21*b* in the upstream side from the throttle valve 23. The starter passage 26 is provided separately from the air screw passage.

A start opening and closing valve 28 operated so as to be moved by a drive member 27, in which a heat expansion and contraction material such as a wax or the like is sealed in an inner portion, variably adjusts an opening area of the starter passage 26, whereby an air flowing within the starter passage 26 is controlled.

In other words, in a low temperature state in which the engine atmosphere temperature is equal to or less than a fixed temperature, the heat expansion and contraction material reduces its volume, an operation lever 27*a* of the drive member 27 moves to a lower side in the drawing, and the start opening and closing valve 28 moves to a lower side in synchronous therewith so as to increase the opening area of the starter passage 26.

Accordingly, in addition to the normal idle air supplied from the air screw passage 24, the first idle air is supplied toward the suction air passage 21*a* in the downstream side from the throttle valve 23 from the starter passage 26, whereby it is possible to execute an engine start (a first idling operation) in the low temperature state.

On the other hand, in a high temperature state in which the engine atmosphere temperature is higher than the fixed temperature, the heat expansion and contraction material expands its volume, the operation lever 27*a* of the drive member 27 moves to an upper side in the drawing, and the start opening and closing valve 28 moves to an upper side in synchronous therewith so as to close the starter passage 26.

In accordance with the structure mentioned above, the first idle air is not supplied into the suction air passage 21*a* in the downstream side from the throttle valve 23 from the starter passage 26, but the normal idle air is supplied to the suction air passage 21*a* in the downstream side from the throttle valve 23 from the air screw passage 24, whereby the engine start in the higher temperature state than the fixed temperature is executed.

In other words, in the case that the engine atmosphere temperature is in the normal temperature region including the hot time, the engine start and the idle operation are executed by the normal idle air supplied from the air screw passage 24. On the other hand, in the low temperature region of the engine, the engine start and a thereafter warm-up operation are executed by the increased air obtained by adding the first idle air supplied from the starter passage 26 to the normal idle air supplied from the air screw passage 24.

DISCLOSURE OF THE INVENTION

Problem to be Solved by the Invention

In accordance with the conventional idle speed control apparatus mentioned above, since all the passages constructing the starter passage 26 and the air screw passage 24 (corresponding to the upstream and downstream passages separated by the start opening and closing valve 28 and the air screw 25) are independently formed, a freedom of passage design is low, and it is impossible to reduce a working man hour.

Further, since the starter passage 26 and the air screw passage 24 are open to the suction air passage 21*a* in the downstream side from the throttle valve 23, air flow is always generated during the engine operation in the air screw passage 24, however, air flow is shut off in a state in which the engine atmosphere temperature is increased to a level equal to or more than the fixed value during the engine operation in the starter passage 26.

On the other hand, during the engine operation, there is a case that a part of the fuel injected into the suction air passage 21*a* in the downstream side from the fuel injection valve (not shown) is blown back in a direction of the suction air passage 21*b* in the upstream side by the engine, and there is a case that the blown-back fuel goes into the starter passage 26 having no air flow so as to stay.

This matter significantly appears particularly at a time when the opening to the suction air passage 21*a* of the starter passage 26 is open to a lower side in a gravitational direction.

Further, if the fuel staying in the starter passage 26 is sucked out to the suction air passage 21*a* in a state of being accumulated to some extent, there is a case that a concentration of an air-fuel mixture directed to the engine is temporarily changed, causing a rotation fluctuation particularly at the engine idling operation time when the amount of the suction air is less in comparison with the other operation regions.

Further, it is impossible to form a start opening and closing valve guide tube 28*a* slidably supporting the start opening and closing valve 28 and an air screw thread hole 25*a* for screwing the air screw 25 on the same section and in parallel toward the same direction.

This is because the downstream side starter passage 26*a* and the downstream side air screw passage 24*a* are independently formed.

In accordance with the structure mentioned above, it is impossible to improve an assembling property of the drive member 27 including the air screw 25 and the start opening and closing valve 28.

An idle speed control apparatus in a throttle body for a single cylinder in accordance with the present invention is made by taking the problem mentioned above into consideration, and an object of the present invention is to inhibit a matter that blown back fuel stays in an air screw passage and a starter passage and a concentration of an air-fuel mixture becomes temporarily rich even if fuel injected into a suction air passage from a fuel injection valve reaches the passages due to the blown-back, and to particularly inhibit a rotation fluctuation at an engine idling operation.

Further, another object is to improve a freedom of a passage design of the air screw passage and the starter passage, and to improve an assembling property and a maintenance property of a start opening and closing valve including an air screw and a drive member arranged in the passages.

[Means for Solving the Problem]

In order to achieve the object mentioned above, in accordance with a first aspect of the present invention, there is provided an idle speed control apparatus in a throttle body for a single cylinder, comprising:

a throttle body in which a suction air passage is provided through in an inner portion and the suction air passage is opened and closed by a throttle valve attached to a throttle valve shaft, wherein a single idle air control passage is open toward a suction air passage in a downstream side from the throttle valve, a starter passage and an air screw passage directed to a suction air passage in an upstream side from the throttle valve are independently branched from an upstream side passage of the idle air control passage, a start opening and closing valve controlling an opening area of the starter passage by a drive member is arranged in the starter passage, and an air screw controlling an opening area of the air screw passage is arranged in the air screw passage.

Further, in accordance with a second aspect of the present invention, in addition to the first aspect mentioned above, a start opening and closing valve guide tube slidably guiding the start opening and closing valve is continuously provided in the starter passage, an air screw thread hole for screwing the air screw is continuously provided in the air screw passage, and a longitudinal axis of the start opening and closing valve guide tube and a longitudinal axis of the air screw thread hole are set in parallel and are open toward the same direction.

[Effect of the Invention]

In accordance with the first aspect of the present invention, the opening area of the air screw passage is controlled by rotating the air screw, the normal idle air is controlled, and the normal idle air is supplied to the suction air passage in the downstream side from the throttle valve from the idle air control passage.

On the other hand, in the low temperature region in which the engine atmosphere temperature is equal to or less than the fixed temperature, the start opening and closing valve releases the starter passage by the drive member so as to control first idle air, and the first idle air is supplied to the suction air passage in the downstream side from the throttle valve via the idle air control passage.

In this case, since the downstream side passage of the idle air control passage is open to the suction air passage in the downstream side from the throttle valve, and the air screw passage and the starter passage communicate with and are open to the upstream side passage of the idle air control passage, it is possible to continuously flow the normal idle air toward the downstream side passage from the upstream side passage of the idle air control passage even if the start opening and closing valve closes the starter passage, during the engine operation.

In accordance with the structure mentioned above, even if the fuel reaches the opening of the downstream side passage of the idle air control passage due to the blow-back of the engine, the normal air flow is generated toward the suction air passage from the downstream side passage. Accordingly, the blown-back fuel neither enters into the idle air control passage nor stay there, whereby the rotation fluctuation at a time of the engine idling operation is not generated.

Further, since the idle air control passage is formed open toward the suction air passage in the downstream side from the throttle valve, and the starter passage and the air screw passage are open to the idle air control passage, it is sufficient that only the single idle air control passage is open to the downstream side suction air passage. Accordingly, the passage structure becomes simple, and it is possible to improve a freedom of the passage design.

Further, in accordance with the second aspect of the present invention, since the starter passage and the air screw passage are independently branched from the idle air control passage, it is possible to set the respective longitudinal axes of the start opening and closing valve guide tube and the air screw hole in parallel and make them open toward the same direction.

In accordance with the structure, since it is possible to work the start opening and closing valve guide tube and the air screw thread hole from the same direction, it is possible to improve a working property thereof.

Further, it is possible to assemble the start opening and closing valve including the drive member and the air screw from the same direction, and it is possible to improve an assembling property and a maintenance property.

[Best Mode for Carrying out the Invention]

A description will be given below of an embodiment of an idle speed control apparatus in a throttle body for a single cylinder in accordance with the present invention with reference to FIG. 1.

Reference numeral 1 denotes a single throttle body connected to a single cylinder engine via a suction air pipe (not shown). A suction air passage 2 is provided through in an inner portion of the throttle body, and the suction air passage is controlled so as to be opened and closed by a throttle valve 4 attached to a throttle valve shaft 3 rotatably supported to the throttle body 1.

Reference numeral 5 denotes a single idle air control passage open toward a suction air passage 2*a* in a downstream side from the throttle valve 4. A starter passage 6 is formed so as to be branched toward a suction air passage 2*b* in an upstream side from the throttle valve 4, and an air screw passage 7 is formed so as to be branched toward the suction air passage 2*b* in the upstream side of the throttle valve 4, from an upstream side passage 5*a* of the idle air control passage 5.

In other words, downstream sides of the starter passage 6 and the air screw passage 7 are connected and open to the upstream side passage 5*a* of the idle air control passage 5.

In this case, upstream sides of the starter passage 6 and the air screw passage 7 are open toward an atmospheric air.

A start opening and closing guide tube 8 is formed in the starter passage 6 so as to be directed toward an upper side in the drawing, an upstream side starter passage 6*a* connected to the suction air passage 2*b* in the upstream side from the throttle valve 4 is open to a side wall of the start opening and closing valve guide tube 8, and a downstream side starter passage 6*b* connected to the upstream side passage 5*a* of the idle air control passage 5 is open to a bottom portion of the start opening and closing valve guide tube 8.

Further, a guide hole 9*a* and an air screw thread hole 9 are formed in the air screw passage 7 so as to be directed to an upper side in the drawing, an upstream side air screw passage 7*a* connected to the suction air passage 2*b* in the upstream side from the throttle valve 4 is open to a side wall of the guide hole 9*a*, and a downstream side air screw passage 7*b* connected to the upstream side passage 5*a* of the idle air control passage 5 is open to a bottom portion of the guide hole 9*a*. In other words, the starter passage 6 is formed by the upstream side starter passage 6*a*, the start opening and closing valve guide tube 8 and the downstream side starter passage 6*b*, an upstream side of the upstream side starter passage 6*a* is open to the suction air passage 2*b* in the upstream side from the throttle valve 4, and a downstream side thereof is open to the side wall of the start opening and closing valve guide tube 8.

Further, an upstream side of the downstream side starter passage 6*b* is open to the bottom portion of the start opening and closing valve guide tube 8, and a downstream side thereof is open to the upstream side passage 5*a* of the idle air control passage 5.

On the other hand, the air screw passage 7 is formed by the upstream side air screw passage 7*a*, the air screw thread hole 9 including the guide hole 9*a*, and the downstream side air screw passage 7*b*, and an upstream side of the upstream side air screw passage 7*a* is open to the suction air passage 2*b* in the upstream side from the throttle valve 4, a downstream side thereof is open to the side wall of the guide hole 9*a*, and an upstream side of the downstream side air screw passage 7*b* is open to the bottom portion of the guide hole 9*a*, and a downstream side thereof is open to the upstream side passage 5*a* of the idle air control passage 5.

A start opening and closing valve 10 operated so as to be moved by a drive member W such as a wax, a stepping motor or the like is slidably arranged within the start opening and closing valve guide tube 8 of the starter passage 6.

The drive member W is structured such that an output lever Wa is moved forward and backward in a vertical direction in the drawing by detecting an engine temperature and an engine atmosphere temperature. In the case that the engine atmosphere temperature is equal to or more than a fixed temperature, the output lever Wa is extended in a downward direction, and the start opening and closing valve 10 is moved downward in synchronous with the output lever Wa, and closes the upstream side starter passage 6*a* open to the start opening and closing valve guide tube 8.

On the other hand, in the case that the engine atmosphere temperature is equal to or more than the fixed temperature, the output lever Wa is contracted in an upward direction, and the start opening and closing valve 10 is moved upward in synchronous with the output lever Wa, and opens the upstream side starter passage 6*a* toward the start opening and closing valve guide tube 8.

An air screw 11 is arranged so as to be screwed into the air screw thread hole 9.

In particular, a male thread 11*b* in an upper side of the air screw 11 is screwed into the air screw thread hole 9, and a lower cylinder portion 11*a* is arranged within the guide hole 9*a* at a small gap.

In accordance with the structure mentioned above, it is possible to control an opening area of the upstream side air screw passage 7*a* open to the guide hole 9*a* by rotating the air screw 11.

Further, an idling operation of the engine is executed in accordance with the following manner.

The air screw 11 is rotated for adjustment, and the opening to the guide hole 9*a* of the upstream side air screw passage 7*a* is adjusted by the cylinder portion 11*a*, whereby an idle air toward the downstream side air screw passage 7*b* from the upstream side air screw passage 7*a* is properly adjusted and determined.

Further, the idle air adjusted as mentioned above is supplied to the suction air passage 2*a* in the downstream side from the throttle valve 4 via the idle air control passage 5, whereby it is possible to well execute the idling operation of the engine.

On the other hand, in the low temperature region in which the engine atmosphere temperature is lower than the predetermined temperature, the drive member W including the output lever Wa moves upward, and the start opening and closing valve 10 opens the upstream side starter passage 6*a* to the start opening and closing valve guide tube 8.

In accordance with the structure, the first idle air for starting is supplied toward the downstream side starter passage 6*b* from the upstream side starter passage 6*a* via the start opening and closing valve guide tube 8, and the air in total of the first idle air supplied from the starter passage 6 and the idle air supplied from the air screw passage 7 is supplied to the suction air passage 2*a* in the engine side from the throttle valve 4, via the idle air control passage 5, whereby it is possible to execute a well engine start in the low temperature region.

Further, if the engine operation is continued, and the engine atmosphere temperature is increased from the temperature state mentioned above, the output lever Wa of the drive member W moved downward gradually, whereby the start opening and closing valve 10 closes the upstream side starter passage 6*a* gradually, and the start opening and closing valve 10 finally closes the upstream side starter passage 6*a* fully so as to stop the supply of the first idle air. Accordingly, it is possible to well execute a warm-up operation.

In the thereafter engine operation, the idling operation of the engine is well continued by the idle air supplied from the air screw passage 7 via the idle air control passage 5.

In this case, in accordance with the idle speed control apparatus on the basis of the present invention, the air stream always exists within the idle air control passage 5 open to the suction air passage 2*a* in the downstream side from the throttle valve 4 in all the operation regions of the engine.

In other words, the idle air is supplied toward the idle air control passage 5 from the air screw passage 7 in all the operation regions of the engine, and the first idle air is additionally supplied toward the idle air control passage 5 from the starter passage 6 in the low temperature region of the engine atmosphere temperature.

Since the air stream always exists from the downstream side passage 5*b* of the idle air control passage 5 toward the inner side of the suction air passage 2*a* in the downstream side from the throttle valve 4, in all the operation regions of the engine, the blown-back fuel neither enters into the idle air control passage 5 nor the fuel stays within the passage 5 due to the air stream, even if the blown-back fuel within the suction air passage 2*a* is going to enter into the downstream side passage 5*b* of the idle air control passage 5 by the blowing-back of the fuel.

In accordance with the structure mentioned above, since the change of concentration of the air-fuel mixture is not generated by the staying fuel, particularly at a time of the idling operation of the engine, it is possible to execute a stable idling operation.

Further, since the single idle air control passage 5 is provided toward the suction air passage 2*a* in the downstream side from the throttle valve 4, and the other downstream side starter passage 6*b* and downstream side air screw passage 7*b* may only communicate with the idle air control passage 5, it is possible to largely improve the freedom of the passage design.

Further, since the idle air control passage 5 is commonly used by the starter passage 6 and the air screw passage 7, it is possible to reduce a working man hour of the passage.

Since a longitudinal axis X-X of the start opening and closing valve guide tube 8 continuously provided in the starter passage 6 and a longitudinal axis Y-Y of the air screw thread hole 9 including the guide hole 9*a* continuously provided in the air screw passage 7 are set in parallel to each other and are open toward the upper side in the drawing, it is possible to work to form the start opening and closing valve guide tube 8 including the downstream side starter passage 6*b*, the downstream side air screw passage 7*b*, and the air screw thread hole 9 including the guide hole 9*a* from the same direction, and it is possible to efficiently work them.

Further, it is possible to assemble the drive member w including the start opening and closing valve 10 and the air screw 11 including the cylinder portion 11*a* from the same direction, and it is possible to improve a maintenance property as well as it is possible to improve an assembling property.

DESCRIPTION OF THE REFERENCE SYMBOLS

Figure 1:
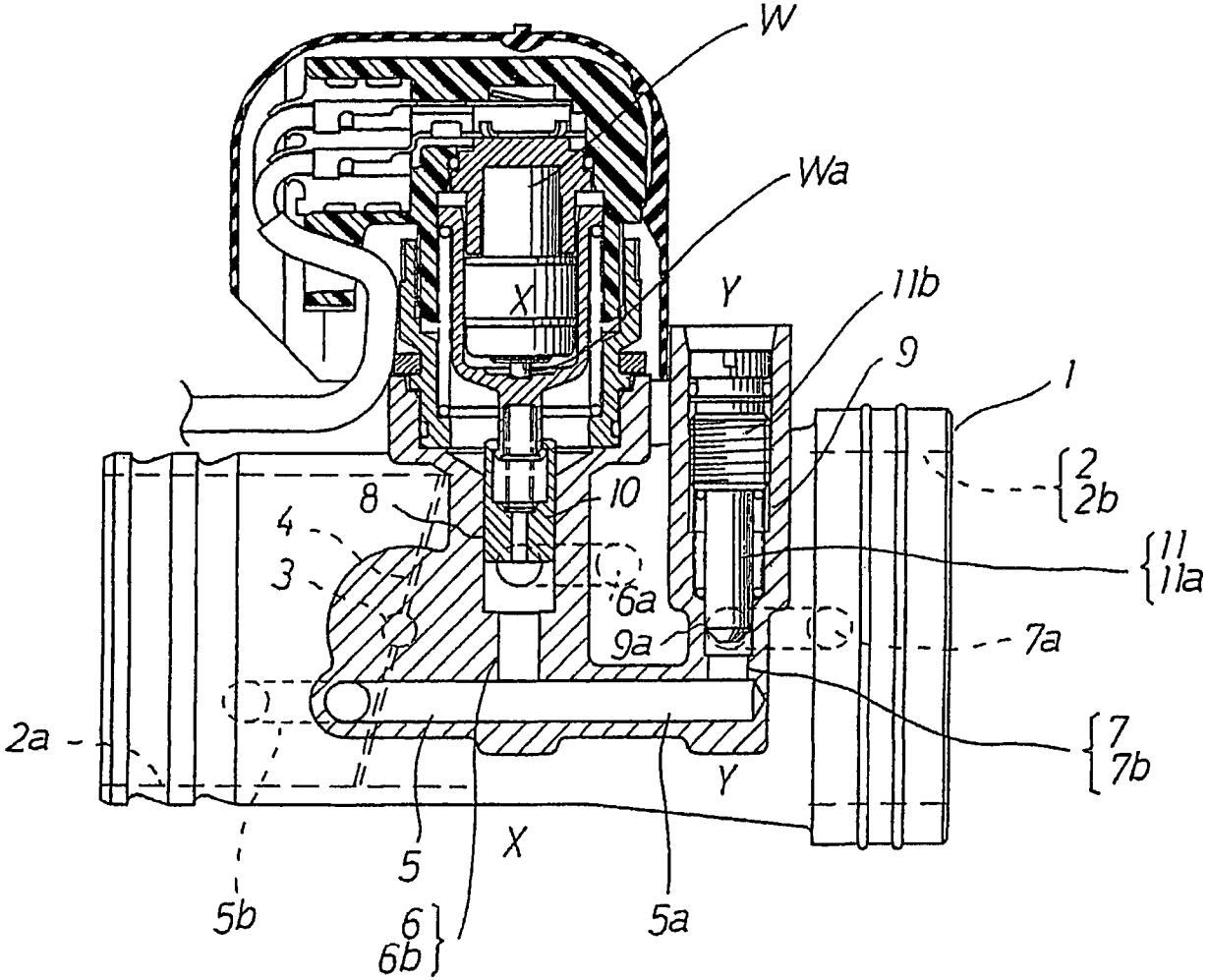
FIG. 1 a vertical sectional view of a main portion showing an embodiment of an idle speed control apparatus in a throttle body for a single cylinder in accordance with the present invention.
Figure 2:
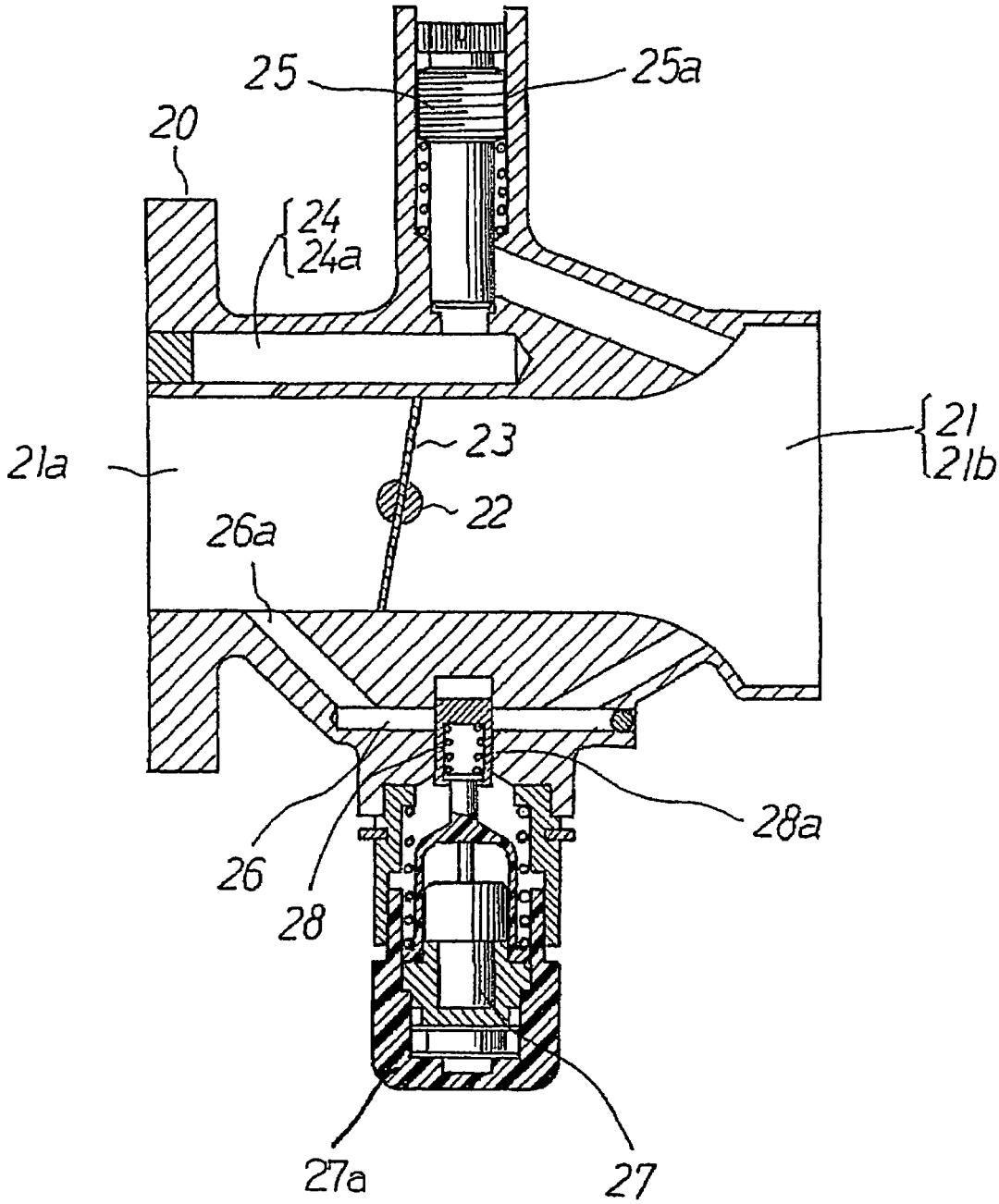
FIG. 2 a vertical sectional view showing a conventional idle speed control apparatus.

1 throttle body
2 Suction air passage
2*a* Suction air passage in a downstream side from the throttle valve
2*b* Suction air passage in an upstream side from the throttle valve
4 Throttle valve
6 Starter passage
7 Air screw passage
10 Start opening and closing valve
11 Air screw

The invention claimed is:

1. An idle speed control apparatus in a throttle body for a single cylinder, comprising:

a throttle body (1) in which a suction air passage (2) is provided through in an inner portion and said suction air passage is opened and closed by a throttle valve (4) attached to a throttle valve shaft (3), wherein a single idle air control passage (5) is open toward a suction air passage (2*a*) in a downstream side from the throttle valve (4), a starter passage (6) and an air screw passage (7) directed to a suction air passage (2*b*) in an upstream side from the throttle valve (4) are independently branched from an upstream side passage (5*a*) of said idle air control passage (5), a start opening and closing valve (10) controlling an opening area of the starter passage (6) by a drive member (W) is arranged in said starter passage, and an air screw (11) controlling an opening area of the air screw passage (7) is arranged in the air screw passage (7).

2. An idle speed control apparatus in a throttle body for a single cylinder as claimed in claim 1, wherein a start opening and closing valve guide tube (8) slidably guiding the start opening and closing valve (10) is continuously provided in said starter passage, an air screw thread hole (9) for screwing the air screw is continuously provided in the air screw passage (7), and a longitudinal axis (X-X) of said start opening and closing valve guide tube and a longitudinal axis (Y-Y) of the air screw threadhole (9) are set in parallel and are open toward the same direction.

* * * * *